United States Patent [19]

Weiss

[11] 4,077,066

[45] Mar. 7, 1978

[54] WASH-AND-WEAR GARMENT PLACKET, COLLAR AND CUFFS

[76] Inventor: George Weiss, 520 Magnolia Blvd., Long Beach, N.Y. 11561

[21] Appl. No.: 779,266

[22] Filed: Mar. 18, 1977

[51] Int. Cl.[2] ..... A41B 3/00

[52] U.S. Cl. ..... 2/129

[58] Field of Search ..... 2/115, 243 R, 129, 128, 2/116

[56] References Cited

U.S. PATENT DOCUMENTS

| | | | |
|---|---|---|---|
| 3,435,463 | 4/1969 | Jay | 2/243 B |
| 3,453,662 | 7/1969 | Weiss | 2/243 B |

*Primary Examiner*—Doris L. Troutman

*Attorney, Agent, or Firm*—Bauer, Amer & King

[57] ABSTRACT

The garment parts hereof, namely the garment placket, collar and cuffs, have a smooth, neat appearance, obviating the need even for touch-up ironing, and thus are particularly suitable for wash-and-wear promotion. Moreover, the fabric for these parts, although not possessing "recoverable" stretch and thus heretofore unsuitable for my prior patented sewing technique for achieving pucker-free seams (U.S. Pat. No. 3,453,662), are now adapted to be sewn so as to provide the patented result noted. To a significant extent, this desired wash-and-wear performance is achieved by an artificially created "recoverable" stretch in the lining fabric. That is, the invention contemplates converting, by attachment of a control strip to said lining, what is ordinarily bias stretch of a non-recoverable nature therein into that of a recoverable nature, with the result that said "stretch recovery" relieves the sewing thread of tension and tautness and thus minimizes stitch pucker, wrinkles and the like from being manifested in the shirting fabric.

In result therefore, the control strip solves a dilemma presented in the sewing of non-stretch fabrics. The dimensional stability of the non-stretch liner in the straight is required, yet it is unusable because it sews very badly. A bias interliner is also unusable because, while sewing well, it elongates under the stress of the sewing operation and thereafter shrinks back to the dimension of the non-stretch shirting being sewn together with it, causing pucker, bubbles, ripples and distortion after the sewing operation has been completed. The liner and control strip combination thus contemplated in this invention gives the dimensional stability of non-stretch coupled with the sewing qualities of stretch, all to the end of providing the favorable sewing result as set forth in my prior patent, U.S. Pat. No. 3,453,662.

12 Claims, 13 Drawing Figures

WASH-AND-WEAR GARMENT PLACKET, COLLAR AND CUFFS

The present invention relates generally to improvements for achieving smooth, neat-appearing plackets, collars and cuffs for garments using the technique for relieving tension in the sewing thread underlying my prior patented invention of U.S. Pat. No. 3,453,662; and more particularly is concerned with effectively making available said sewing technique for heretofore excluded fabrics, thus significantly enhancing the commercial acceptance and use of these fabrics for garment manufacture.

In accordance with my prior patented sewing technique which, as noted above, is set forth in U.S. Pat. No. 3,453,662, "recoverable" stretch in qualifying fabrics can advantageously be used to produce sewing that is free of stitch pucker, wrinkles, and other appearance-marring conditions in the fabric being sewn. As defined in said patent, the "recovery" is the return of the stretched fabric to its original condition, a movement which effectively relieves the stitches applied to the fabric of tension, and thus correspondingly promotes a smooth and neat appearance in the fabric in the vicinity of the stitches. Although a wide range of fabrics have the necessary attributes to qualify for use with my prior patented sewing technique, heretofore those fabrics without "recoverable" stretch could not be used, and these fabrics therefore could not satisfactorily be used for wash-and-wear garments.

Broadly, an object of the present invention is to provide a commercially acceptable, from an appearance viewpoint, garment placket, collar and cuffs, using hard-to-sew fabric, i.e. without "recoverable" stretch, overcoming the foregoing and other shortcomings of the prior art. Specifically, it is an object to convert what is ordinarily non-recoverable bias stretch in a fabric into stretch that is "recoverable", so as to enable putting into practice the sewing technique of my prior U.S. Pat. No. 3,453,662 with fabrics that heretofore were excluded from such use, thereby significantly enhancing the commercial acceptance and utility of such fabrics.

An improved garment placket, demonstrating objects and advantages of the present invention, is of the type formed of an outer fabric ply in enclosed relation about an inner bias-oriented woven interliner ply providing shape and body thereto. As understood, the aforesaid plies of the placket are attached together and along an edge of a front garment panel by spaced apart top stitching applied therethrough. To such placket, the within improvement, which contributes to minimal stitch pucker and the like being manifested in the placket comprises, in cooperating combination with the bias-oriented woven interliner ply, of an additional control ply fabricated of a strip of non-stretch material and sized so that its opposite side edges are in adjacent positions spaced inwardly of corresponding peripheral edges of the bias-oriented woven interliner ply. It has been found in practice that by attaching the control ply or strip in the aforesaid location to the interliner ply that the woven interliner ply yarns immediately adjacent the control ply are adapted to undergo opening movement against the resistance of the non-stretch control ply during the application of the attaching stitching, and that these yarns subsequently undergo corresponding closing movement in response to said resistance when free to do so, all to the end of minimizing tension in the stitching.

The above brief description, as well as further objects, features and advantages of the present invention, will be more fully appreciated by reference to the following detailed description of presently preferred, but nonetheless illustrative embodiments of an improved garment placket, collar and cuffs in accordance with the present invention, when taken in conjunction with the accompanying drawings, wherein.

BACKGROUND

Figure 1:
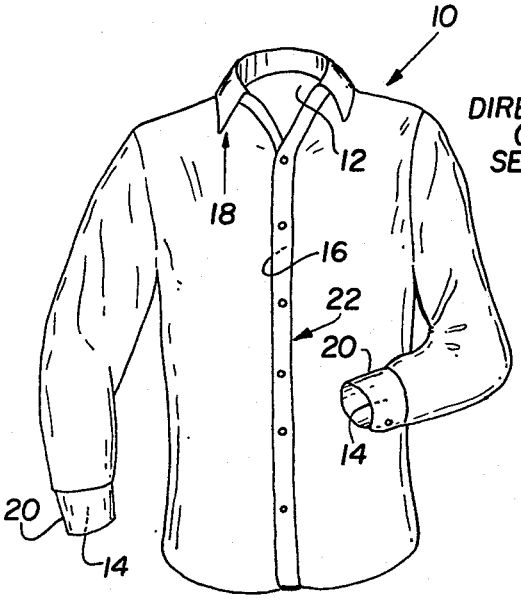
FIG. 1 is a front elevational view of a typical man's shirt having the improved placket, collar and cuffs, according to the present invention, which garment parts cooperate to provide the shirt with a significantly enhanced appearance.

Illustrated in FIG. 1 is a man's shirt, generally designated 10, which has typical multi-ply constructions to finish the otherwise raw edges bounding the neck opening 12, sleeve opening 14, and the panel edges bounding the garment front opening 16, these multi-ply constructions being the garment collar 18, cuffs 20, and placket 22. It is the inventive contribution hereof to provide an improved construction for the aforesaid garment attachments or parts 18, 20 and 22 which results in the obviating, to a significant degree, of any stitch pucker, wrinkles, ripples, distortion, or any other manifestation of surface uneveness which detracts from the appearance of said collar, cuff or placket. Further, the within contribution is in addition to the sewing technique which similarly obviates stitch pucker, wrinkles and the like in the sewing of fabrics, as set forth in my prior U.S. Pat. No. 3,453,662, but which is applicable only for sewing together of fabrics having "recoverable" stretch as defined in said patent. That is, the within improvements, as hereinafter will be subsequently set forth in detail, are applicable for fabrics which inherently do not have "recoverable" stretch and therefore are outside the scope of my prior patented sewing technique. These heretofore excluded fabrics now, however, when used as herein prescribed in the formation of a garment collar, cuff or placket can now also be sewn without stitch pucker, wrinkles or the like, thus enhancing, in an obvious way, the commercial acceptance and use of these otherwise hard-to-sew fabrics. A notable case in point is a woven fabric sold under the trademark "Qiana" by E. I. DuPont de Nemours & Company, said fabric being of a closely woven construction of fine denier yarns and, because it does not possess "recoverable" stretch, being unable to use the patented sewing technique of my prior U.S. Pat. No. 3,453,662.

Although it will be understood that my prior U.S. Pat. No. 3,453,662 is incorporated by reference herein, it will assist in an understanding of the within inventive contribution to briefly reiterate the aspects of my prior patented sewing technique as it relates to said inventive contribution. More particularly, and as is clearly illustrated in FIGS. 2 and 3, in the sewing attachment of fabrics having "recoverable" stretch, the effect of the feed dogs 24 pushing the fabric from beneath along the sewing path and the pressure 26 exerted by the sewing machine presser foot from above, causes a stretching or elongation, designated 28, in the stretchable fabric in between penetrations of the sewing needle. When, however, the presser foot is cleared, the stretched fabric reverts to its original unstretched condition, with the result that the distance between adjacent needle holes is reduced to the lesser amount designated 30. As explained in detail in said U.S. Pat. No. 3,453,662, the aforesaid stretching and return has the effect of relieving the sewing thread 32 of any tension, which correspondingly significantly minimizes the manifestation of stitch pucker or the like. From the foregoing, even though it is but a summary of a detailed discussion in said referred to patent, it should be obvious that basic to the patented sewing technique is the need for a tendency of the stretchable fabric to return to its original dimension when it is no longer subjected to stretching forces, a characteristic of the fabric that is referred to as "recoverable" stretch.

As further background to the within invention, it should be noted that in the practice of my prior patented sewing technique or method, that both the shirting fabric and the interlining fabric have the requisite "recoverable" stretch to produce the smooth, pucker-free sewing result. In contrast, and as will be discussed subsequently in detail, the present invention contemplates use of a shirting fabric that may be totally devoid of stretch, and the use of a lining fabric having stretch but of the non-recoverable type. Thus, it is proposed using fabrics that ostensibly are not capable of providing the sewing performance of my prior patent. Nevertheless, in a manner subsequently to be described and explained in detail, the present invention relates to an artificially created "recoverable" stretch in the heretofore ordinary, and typically non-recovering stretchable lining fabric, all to the end of effectively imparting the desired patented sewing result in the heretofore hard-to-sew non-stretching shirting fabric. Thus, by the inventive combination proposed herein, one is able to obtain the smooth, pucker-free sewing result of my prior patent. Stated another way, the present invention proposes an effective and practical way of converting, in the lining fabric, what is ordinarily non-recoverable bias stretch into stretch that is "recoverable," at least as far as being able to put into practice the sewing technique of my prior U.S. Pat. No. 3,453,662. As a consequence, the sewing thread is effectively relieved of tension, tautness and the like, and thus correspondingly obviates, in the shirting fabric, any stitch pucker, wrinkles, or other such surface uneveness.

In the description which follows, it will become apparent that the artificially created stretch in the lining fabric results from the union thereof with a non-stretch control strip. Simply stated, this union solves a dilemma presented in the sewing of non-stretch fabrics. The dimensional stability of the non-stretch liner in the straight is required, yet it is unusable because it sews very badly. A bias interliner is also unusable because, while sewing well, it elongates under the stress of the sewing operation and thereafter shrinks back to the dimension of the non-stretch shirting being sewn together with it causing pucker, bubbles, ripples and distortion after the sewing operation has been completed. The liner and control strip combination thus contemplated in this invention gives the dimensional stability of non-stretch coupled with the sewing qualities of stretch, and thus the favorable sewing result as set forth in my prior patent, U.S. Pat. No. 3,453,662.

The Improved Garment Placket

A first embodiment of an improved inventive placket hereof is illustrated in FIGS. 4–7, being generally designated 34. Placket 34 is similar in many respects to the placket described and illustrated in my prior U.S. Pat. No. 3,787,896, which will be understood to be incorporated by reference herein. In the illustrated embodiment thereof the placket includes an outer fabric strip 36 in enclosed relation about a bias-oriented interliner strip 38 which has its opposite marginal edges folded inwardly, as at 40 and 42, so as to provide the necessary bulk supporting the opposite edges 44 and 46 of the placket fabric so as to obviate any collapse therein, and thus the manifestation of wrinkles or the like which otherwise would result from an unsupported and thus collapsing fabric. The foregoing is explained in detail in my referred to prior U.S. Pat. No. 3,787,896.

While, as just explained, wrinkles or the like are obviated by supporting the edges 44 and 46, it is also necessary in order to provide a neat appearance for the placket 34 to similarly obviate the manifestation of wrinkles, in the specific form of stitch pucker, from occurring in the hard-to-sew placket fabric 36 during application of the attaching spaced apart seams of top stitching 48 and 50. This is achieved by changing the nature of the bias stretch of the bias-oriented strip 38, which is ordinarily non-recoverable, i.e. inherently not capable of being stretched and automatically, when released, returning to its unstretched dimension, into stretch which is of a recoverable nature, and thereby advantageously using the sewing technique of my prior U.S. Pat. No. 3,453,662 to prevent tension in the sewing thread from causing fabric wrinkling or puckering.

Figure 4:
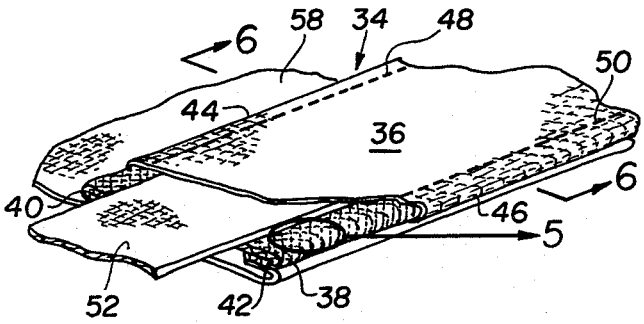
FIG. 4 is a perspective view of a first embodiment of an improved placket according to the present invention.
Figure 5:
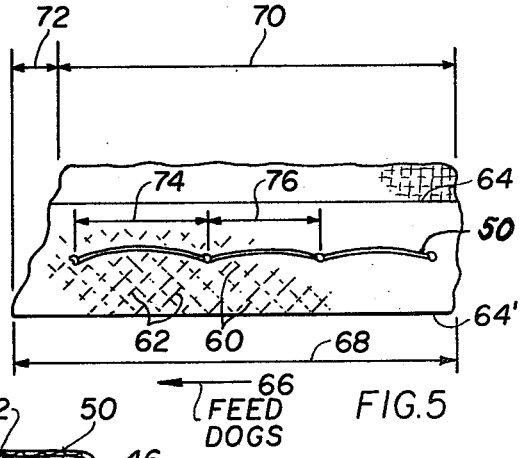
FIG. 5 is a perspective view, on an enlarged scale, of the aforesaid garment placket which illustrates the improvements embodied therein which contribute to minimal stitch pucker and the avoidance of other such surface uneveness which detracts from the appearance of the placket.
Figure 6:
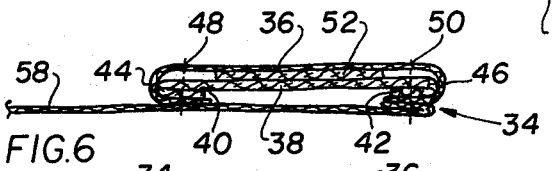
FIG. 6 is a side elevational view of the placket resulting from the arrangement of components of FIG. 4, in section taken along line 6—6 of FIG. 4, illustrating further structural features thereof.

The conversion of bias stretch into artificially created "recoverable" stretch is achieved in accordance with the present invention by including as an addition to my prior patented placket construction an additional component, 52, which for the placket 34 exerts a desirable supervising control over the stretch of the interliner strip 38. More particularly, strip 52 is fabricated of non-stretching material and is strategically located, as illustrated in FIG. 4, in a physically attached relation centrally and longitudinally of the interliner strip 38, the attachment either being by heat fusion, assuming appropriate materials having a plastic content, or by use of an adhesive.

Figure 7:
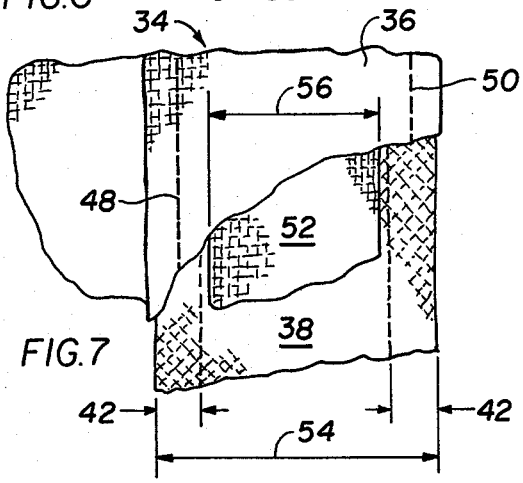
FIG. 7 is a plan view illustrating the placket of FIG. 4 at an initial stage of its manufacture.

In FIG. 7, the superposed arrangement of the plies is shown in the flat, and thus at an initial stage of manufacture prior to being fed through appropriate folding scrolls which provide the folded under edges in the outer placket fabric 36 and in the shaping bias-oriented interliner strip 38.

In this same illustrated embodiment it is preferred that both the fabric ply 36 and interliner ply 38 in the flat measure approximately 2½ inches in width 54, and that the strip 52, measuring approximately ¾ of an inch in its width 56, by appropriately secured centrally and longitudinally of the interliner strip 38. This arrangement of plies as just described is then fed through folding scrolls so that each opposite marginal portion of the interliner ply 38, designated 40 and 42, each measuring approximately ½ inch, exits from the folders and enters the sewing station in the folded condition illustrated in FIG. 6 for attachment along the edge of the garment panel 58 using top stitch seams 48 and 50.

Figure 2:
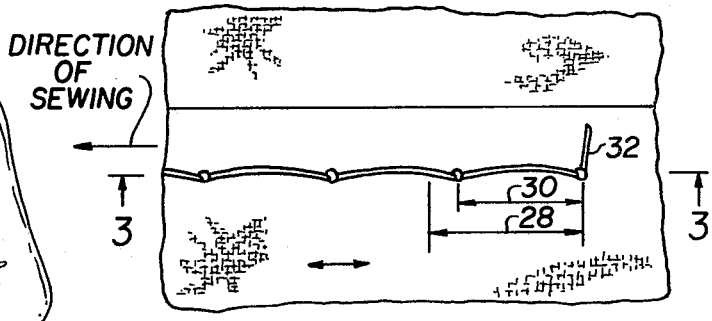
FIGS. 2 and 3 are respectively a partial plan and side elevational view of a seam attaching two fabric plies, the latter or side elevational view of FIG. 3 being taken along lines 3—3 of FIG. 2; these figures illustrating the application of a pucker-free seam based on known patented sewing techniques.
Figure 3:
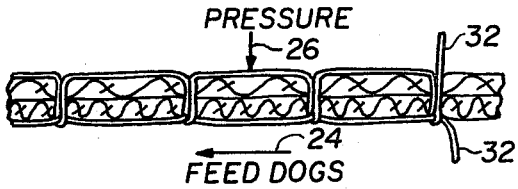

The importance of the securement or attachment together of the strips or plies 38 and 52 is that it results in a degree of control being capable of being exercised by the ply 52 over the stretch of the ply 38 in that ply 52 fixes the position of the angularly oriented warp and fill yarns 60 and 62, respectively, of the bias-oriented interliner ply 38. The significance of this may best be appreciated by a consideration of FIG. 5, to which reference should now be made. In the application of the right-hand top stitching 50, a stitching which is applied in the marginal area of the interliner ply 38 between the control panel edge 64 and its counterpart or cooperating interliner ply edge 64', the combined effect of the forces exerted on the multi-ply arrangement by the feed dogs urging the placket 34 through feed movement 66 and the pressure exerted thereon by the sewing machine presser foot, is to cause bias stretch or opening movement in the liner angularly oriented yarns 60 and 62 adjacent the control ply edge 64. Each individual stitch of the seam 70 is thus deposited in an opened woven construction in the peripheral portion of the interliner ply, due to the stretching of said portion to an increased dimension 68. This stretching phenomenon is similar and occurs essentially for the reasons discussed in relation to FIGS. 2 and 3, with the important significant difference that said stretching is against the resistance of the dimensionally stable, non-stretching control panel 52 which is adjacent, as at 64, to the top stitch seam 50. Thus, once the presser foot is cleared, the resistance of the control panel 52 exerted along edge 64 is effective in closing, or urging the rearranged warp and fill yarns 60 and 62 to return to their original relationship which restores the original dimension 70 to the peripheral portion of the interliner ply 38. In effect, therefore, the difference between the original dimension 70 and the stretched dimension 68, or namely the distance 72, is the amount of "recoverable" stretch which is effectively imparted to the bias-oriented interliner ply 38. To further demonstrate this, in FIG. 5 it will be understood that reference numeral 74 illustrates the increased span between adjacent needle penetrations similar to distance 28 of FIG. 2, whereas the ultimately resulting normal stitch span, similar to that designated 30 in FIG. 2, is designated 76 in FIG. 5.

It should be further noted that although only the interliner ply 38 is provided with recoverable stretch as a result of its combination with the control panel 52, as just explained, that this extent of "recoverable" stretch in the multi-ply construction forming the placket 34 is sufficient to promote minimal stitch pucker therein. In other words, the release of tension in the sewing thread for each top stitch seam 48, 50, because of the favorable diminishment in size of the interliner ply 38 in the areas occupied by these seams is, by itself, sufficient to obviate significant stitch pucker, and does not require corresponding diminishment in size of the placket fabric ply 36 also co-extensive with the seams 48, 50. The foregoing favorable result provided by the artificially created recoverable stretch in the interliner is to a significant extent independent of the orientation of the placket or garment fabric, and thus these fabrics are utilized on the straight since this is an orientation favored by manufacturers.

It should also be noted that control ply 52 in the areas where it is co-extensive with the interliner ply 38 exercises a control on the interliner ply 38 which imparts to it dimensional stability. That is, whereas a bias-oriented woven construction ordinarily is unstable in terms of its size and shape when subjected to forces which tend to elongate it, a phenomenon which produces buckling, rippling and other surface uneveness, the union of the control panel 52 to the bias-oriented interliner ply 38 avoids this problem. That is, interliner 38 in the spaced apart locations where the top stitching 48 and 50 is applied is stabilized in its dimension by its attachment to the non-stretching control strip 52, and thus it is much easier to apply the top stitching 48 and 50 without uneven or unequal stretching occurring at the specific locations where the seams are deposited. The placket 34 with the improvement consisting of the additional non-stretching control strip 52 thus has a significantly enhanced appearance totally devoid of not only stitch pucker, but also ripples, wrinkles or the like, that otherwise might result from unequal stretching along the two top seams 48 and 50.

Figure 8:
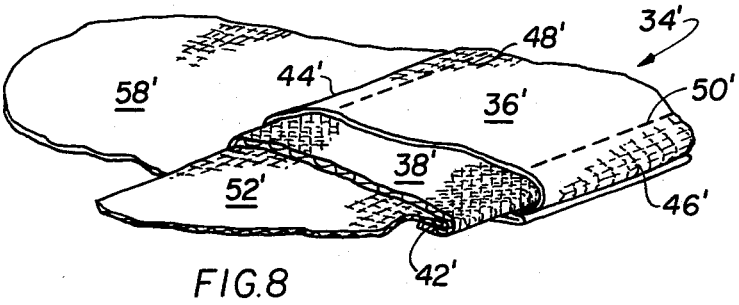
FIG. 8 is a perspective view similar to FIG. 4, but illustrating a second embodiment of the within improved garment placket.

Reference is now made to a second embodiment of an improved garment placket according to the present invention, the same being illustrated in FIG. 8. Since this second embodiment has many of the same structural features already described in connection with the placket embodiment of FIGS. 4–7, these similar structural features will be denoted by the same, but primed, reference numerals. As illustrated in FIG. 8, and also constituting an addition to my prior patented placket, use is made in said placket construction of the additional control strip 52'. More particularly, strip 52' is fabricated of a non-stretching material and is strategically located, as illustrated in FIG. 8, beneath the medial portion of the bias-oriented strip 38' and on top of the folded under marginal portions 40' and 42' thereof. Thus, the control strip 52' has its upper surface in contact with the medial portion of the bias-oriented liner 38' and its opposite surface in contact with the folded under edge portions 40' and 42' of the interliner. In this sandwiched position of the control strip 52', it has been noted in practice that the strip imparts its non-stretching attribute or, stated another way, its dimensional stability, to the co-extensive medial area of the bias-oriented interliner strip 38'.

For reasons already explained, including primarily that control strip 52' effectively converts the bias stretch of the marginal areas of the interliner strip 38' into "recoverable" stretch which relieves thread tension and thus obviates stitch pucker, it has been found in practice that a sewn or top stitched placket 34' with the improvement consisting of the additional non-stretching control strip 52' thus has a significantly enhanced appearance totally devoid of ripples, wrinkles or the like, that is readily duplicated by seamstresses with commercially acceptable sewing skills.

An exemplary placket having the construction of FIG. 8 with which noteworthy results have been consistently achieved is that in which the outer placket fabric 36' and garment panel fabric 58' are comprised of woven Qiana having a printed design thereon. Because of the printed design, as well as to achieve maximum yield and other commercial objectives, both the fabrics 36' and 58' are used on the straight. The remaining placket components, namely the interliner strip 38' and the control strip 52' consisted, respectively, of 250 denier bias-oriented woven Dacron Polyester of non-stretchable, non-woven bonded polyester material sold under the trademark Remay by E. I. DuPont de Nemours & Co. During application of the attaching seams 48', 50', it is recommended for best results that the sewing machine feed dogs, the sewing machine roller or puller, and also the seamstress, exert such forces in the appropriate direction resulting in an optimum, maximum stretch in the interliner strip 38', so that the "recoverable" stretch that is artificially created therein is also of a corresponding optimum maximum.

The Improved Garment Collar And Cuffs

Figure 9A:
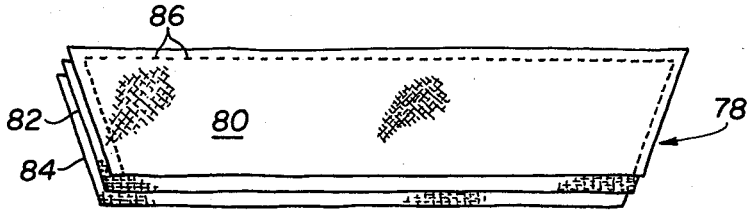
FIG.9A PRIOR ART
FIGS. 9A and 9B are perspective views illustrating known techniques of producing a typical stitch-and-turn garment collar.
Figure 9B:
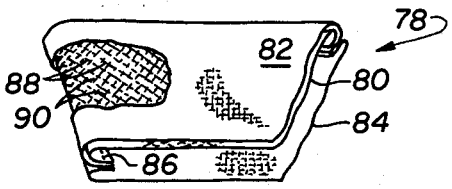
FIG.9B PRIOR ART

As a preliminary to the description of how bias stretch in fabric is rendered recoverable and usefully applied in the making of collars and cuffs, it is helpful to first make note of currently used sewing techniques in the formation of collars and cuffs which make it particularly necessary to apply additional sewing techniques in the formation of these constructions in order to eliminate stitch pucker, wrinkles and the like. In other words, and as now will be explained, because of the typical manner in which these multi-ply constructions, using a collar as an example, are assembled and sewn, they are more vulnerable to stitch pucker, wrinkles and the like and thus unless precautions are taken, these multi-ply constructions cannot easily be imparted with a smooth, neat appearance. Referring to FIGS. 9A, 9B of a typical prior art collar, generally designated 78, the same in an initial stage of its formation, illustrated in FIG. 9A, consists of a superposed arrangement of a woven interliner ply 80 and fabric plies 82 and 84, each having the collar shape as illustrated. In the application of the traditional stitch-and-turn technique for finishing raw or cut edges of fabric, run stitching 86 is applied about the periphery thereof, and the construction is then turned inside-out about the run stitching 86, as illustrated in FIG. 9B, thus projecting the fabric plies 82 and 84 to the outside, and the interliner ply 80 to the inside, said interliner ply providing shape and body to the resulting collar 78. As further understood, and as illustrated by the broken-away portion of the outer collar ply 82, it is necessary that the interliner ply 80 be oriented on the bias so that the angularly oriented warp and fill yarns 88 and 90, respectively, extend throughout the reverse curvature produced in the interliner ply 80 as a result of the construction being turned inside-out about the run stitching 80. Stated another way, it is known that if the interliner ply 80 is oriented on the straight, that this will result in cracking and points of stress being created in the interliner ply adjacent the run stitching 86, and also in this curved portion of the interliner ply thereby not being able to provide adequate smooth support to the visible collar ply 82.

Summarizing the aforesaid discussion, the difficulties in producing a smooth and neat appearing collar are therefore attributable, to a significant extent, to the fact that the fabric and interliner plies utilized do not have "recoverable" stretch, and therefore do not relieve pucker-producing tension in the sewing thread. Aggravating the problem is the fact that conventional cutting of shirting fabrics is on the straight, particularly for patterned shirtings, and thus the garment die-cut parts or components must be used in this orientation. The significance of this will now be explained.

For reasons already mentioned, it is necessary to use the interliner ply 80 on the bias, an orientation in which this ply manifests considerable stretch, whereas the fabric plies 82 and 84 are preferably utilized on the straight, an orientation in which they might manifest no stretch whatsoever. It has been found that when stretching together a multi-ply arrangement in which there is different stretch capacities in the various plies, that the stretching produces distortion, rippling and buckling in the resulting garment part. It is theorized that this is due to the change in the dimension and shape of the interliner ply 80 due to stretching therein, and a lack of a conforming change occurring in the dimensionally stabilized fabric plies 82 and 84.

Figure 10:
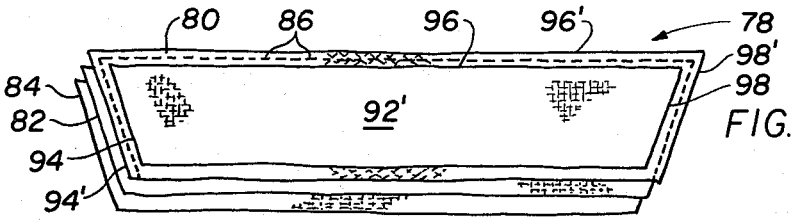
FIG. 10 is a partial perspective view illustrating how the within improved structural features applied to a collar contribute to minimal stitch pucker in the sewing attachment of the plies of said collar.

The within advance in technology will now be described as applied to a typical, so-called stitch-and-turn garment collar, generally designated 78 in FIGS. 9A, 9B and 10. Collar 78 will be understood to be comprised of a superposed arrangement of a collar-shape interliner ply 80, cut on the bias, and two fabric plies 82 and 84. To demonstrate the utility of the within invention, it may even be assumed that the fabric of the plies 82 and 84 is of the hard-to-sew non-stretching type, and that each ply is furthermore oriented on the straight. As illustrated in FIG. 9A, the stitch-and-turn technique construction contemplates the application around the periphery of run stitching 86. As a significant addition to the collar 78, however, there is provided in cooperating combination with the bias-oriented interliner ply 80 a non-stretch control ply 92 appropriately secured to the interliner ply 80. Appropriate material for the control ply 92 will be subsequently noted, but it suffices at this time that the construction material appropriate for the control panel 92 have, similar to the interliner ply 80, a no-shrink property and that it also be essentially non-stretchable. Control panel 92, as clearly illustrated in FIG. 10, has a collar shape that is sized so that when centrally located on the interliner ply 80 its peripheral edges, specifically designated 94, 96 and 98, are strategically located in adjacent positions spaced inwardly of corresponding peripheral edges, designated by the same but primed reference numerals, of the interliner ply 80. Any appropriate means may be utilized in securing the control ply 92 in the strategic location just described to the interliner ply 80, such as heat fusion, assuming an appropriate plastic content in either the control ply 80 or in the interliner ply 92, or by the use of an adhesive surface at the interface of the plies 80 and 92, or by other such means. The important fact is that following the securement or attachment together of the plies 80 and 92, that the control exercised by the ply 92 is that it fixes the position of the angularly oriented warp and fill yarns 88 and 90, respectively, of the bias-oriented interliner ply 80. As already explained in connection with FIG. 5, the significance of the foregoing is that during the application of the run stitching 86, each individual stitch of the seam 86 is deposited in a woven construction that is temporarily opened or stretched, said stretching being against the resistance of the dimensionally stable, non-stretching control panel 92 which is adjacent to the run stitch seam 86. Thus, once the presser foot is cleared, the resistance of the control panel 92 exerted along edges 94, 96 and 98 is effective in closing, or urging the rearranged warp and fill yarns 88 and 90 to return to their original relationship which restores the original dimension to the peripheral portion of the interliner ply 80.

Figure 11:
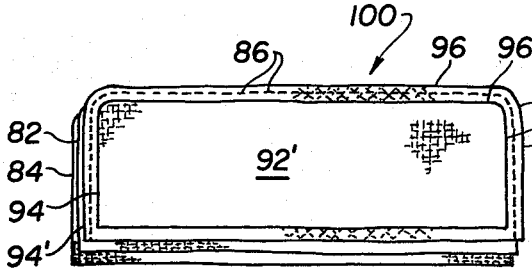
FIG. 11 is similar to FIG. 10, but illustrates a work-in-process cuff, as distinguished from a collar, embodying the improved structural features according to the present invention.
Figure 12:
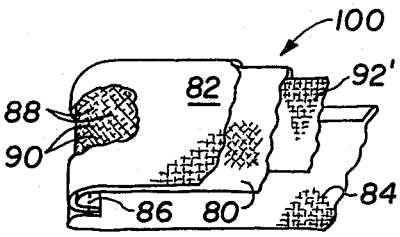
FIG. 12 is a perspective view illustrating said cuff after it has been turned about the run stitching uniting the plies thereof.

Reference should now be made to FIGS. 11 and 12 which illustrate the application of the advanced technology hereof to the manufacture and construction of an improved garment cuff according to the present invention. More particularly, cuff 100, like collar 78, is a multi-ply construction which, in accordance with the present invention, includes components and structural features previously described, except that the plies are in a cuff shape rather than a collar shape. For brevity sake, the improved cuff 100 hereof will therefore not be described, since the construction thereof should be completely and fully understood as a result of the use of the same reference numerals in FIGS. 11 and 12 to describe the same structural features of the collar of FIGS. 9A, 9B and 10.

SUMMARY

From the foregoing, it should be readily appreciated that in multi-ply constructions for garments, specifically the placket, collar and cuffs, it is necessary that the interliner which provides body and shape to these garment parts be oriented on the bias so that at the locations where the supporting interliner undergoes a reverse in curvature that the angularly oriented warp and fill yarns of the interliner provide the necessary support for the fabric of these constructions at this change in curvature. The application to such a bias-oriented interliner of the within control panel as hereinbefore discussed significantly enhances the functioning of the interliner in many respects. Among these is the fact that the control panel or strip, due to its dimensional stability and its strategic location adjacent to where the attaching seam is applied, converts the bias stretch of the interliner to stretch which is "recoverable," and thus stretch which promotes minimal stitch pucker as explained in my prior U.S. Pat. No. 3,453,662. Additionally, the application of the non-stretch ply in controlling relation to the bias-oriented interliner ply significantly minimizes distortion due to differential stretch and other such responses of the multiple plies of the construction to the forces imposed on the construction during sewing thereof. Thus a garment embodying the improved placket, collar and cuffs according to the present invention, even when using hard-to-sew fabric, has an unexcelled neat appearance.

It will be understood that the within improvements for a garment placket, collar and cuffs can be applied to a wide range of materials. For completeness sake, however, it is mentioned that favorable results were achieved using for the control ply or strip a non-woven bonded polyester, the bonding material thereof being of plastic content and therefore enabling heat fusion of this ply to the interliner. For the interliner, favorable results were achieved using a 250 denier polyester woven construction which is commercially available in selected degrees of stiffness. Fabric that can be utilized, as already mentioned, can even include a woven construction which has totally no stretch on the straight and which, although manifesting elongation on the bias has no inherent ability to recover from this stretched condition and return to its original unstretched dimension.

As a final matter, it will of course be understood that the improved collar and cuff hereof can be traditionally finished with top stitching (not shown), without adverse effect on their appearance. As understood, this stitching, being applied through the multi-ply construction after it has been turned about the run stitching and after the plies are fixed in their relative positions, does not normally cause puckering, wrinkling or the like in the visible fabric plies.

It is of course also to be understood that the invention hereof is not to be limited to the just mentioned materials, and further that a latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. An improved multi-ply construction for finishing an edge of a garment, said construction being of the type fabricated of at least one outer fabric ply and having an inner bias-oriented woven interliner ply for providing shape and body thereto, said aforesaid plies of said construction being attached together in superposed relation by stitching deposited therethrough, said improvement contributing to the minimal stitch pucker and the like in said construction comprising, in cooperating combination with said bias-oriented woven interliner ply, of an additional control ply fabricated of non-stretch material having peripheral edges bounding a selected shape and sized so that said peripheral edges thereof are in adjacent positions spaced inwardly of corresponding peripheral edges of said bias-oriented woven interliner ply, and securing means for attaching said control ply in said aforesaid location to said interliner ply, whereby said woven interliner ply yarns immediately adjacent said control ply are adapted to undergo opening movement against the resistance of said non-stretch control ply during the application of said stitching and subsequent corresponding closing moving in response to said resistance to thereby minimize tension in said stitching.

2. An improved multi-ply construction for finishing an edge of a garment, said construction being of the type fabricated of outer fabric plies and having an inner bias-oriented woven interliner for providing shape and body thereto, said aforesaid plies of said construction being attached together in a reverse relation by peripheral run stitching applied therethrough and subsequently turned inside-out about said run stitching to provide said construction, said improvement contributing to minimal stitch pucker and the like in said construction comprising, in cooperating combination with said bias-oriented woven interliner ply, of an additional control ply fabricated of non-stretch material having peripheral edges bounding a selected shape and sized so that said peripheral edges thereof are in adjacent positions spaced inwardly of corresponding peripheral edges of said bias-oriented woven interliner ply, and securing means for attaching said control ply in said aforesaid location to said interliner ply, whereby said woven interliner ply yarns immediately adjacent said control ply are adapted to undergo opening movement against the resistance of said non-stretch control ply during the application of said run stitching and subsequent corresponding closing movement in response to said resistance to thereby minimize tension in said run stitching.

3. An improved stitch-and-turn garment collar of the type fabricated of outer fabric plies and having an inner bias-oriented woven interliner ply providing shape and body thereto, said aforesaid plies of said collar being attached together in a reverse relation by peripheral run stitching applied therethrough and subsequently turned inside-out above said run stitching to provide said collar, said improvement contributing to minimal stitch pucker and the like in said collar comprising, in cooperating combination with said bias-oriented woven interliner ply, of an additional control ply fabricated of non-stretch material having peripheral edges bounding a collar shape and sized so that said peripheral edges thereof are in adjacent positions spaced inwardly of corresponding peripheral edges of said bias-oriented woven interliner ply, and securing means for attaching said control ply in said aforesaid location to said interliner ply, whereby said woven interliner ply yarns immediately adjacent said control ply are adapted to undergo opening movement against the resistance of said non-stretch control ply during the application of said run stitching and subsequent corresponding closing movement in response to said resistance to thereby minimize tension in said run stitching.

4. An improved garment collar as claimed in claim 3 wherein said control ply is a substrate having a plastic content, and said means of securing said control and interliner plies together is by heat fusion causing a bonding attachment of said plastic content of said control ply to said interliner ply.

5. An improved garment collar as claimed in claim 4 wherein said control ply is adhesively secured to said interliner ply.

6. An improved stitch-and-turn garment cuff of the type fabricated of outer fabric plies and having an inner bias-oriented woven interliner ply providing shape and body thereto, said aforesaid plies of said cuff being attached together in a reverse relation by peripheral run stitching applied therethrough and subsequently turned inside-out about said run stitching to provide said cuff, said improvement contributing to minimal stitch pucker and the like in said cuff comprising, in cooperating combination with said bias-oriented woven interliner ply, of an additional control ply fabricated of non-stretch material having peripheral edges bounding a cuff shape and sized so that peripheral edges thereof are in adjacent positions spaced inwardly of corresponding peripheral edges of said bias-oriented woven interliner ply, and securing means for attaching said control ply in said aforesaid location to said interliner ply, whereby said woven interliner ply yarns immediately adjacent said control ply are adapted to undergo opening movement against the resistance of said non-stretch control ply during the application of said run stitching and subsequent corresponding closing movement in response to said resistance to thereby minimize tension in said run stitching.

7. An improved garment cuff as claimed in claim 6 wherein said control ply is a substrate having a plastic content, and said means of securing said control and interliner plies together is by heat fusion causing a bonding attachment of said plastic content of said control ply to said interliner ply.

8. An improved garment cuff as claimed in claim 6 wherein said control ply is adhesively secured to said interliner ply.

9. An improved garment placket of the type fabricated of a placket-shaped outer fabric ply having a similarly shaped inner bias-oriented woven interliner ply providing body thereto, said aforesaid plies of said placket being attached to said grment by spaced apart top stitching applied longitudinally therethrough, said improvement contributing to minimal stitch pucker and the like in said placket comprising, in cooperating combination with said bias-oriented woven interliner ply, of an additional control ply fabricated of non-stretch material shaped and sized so that opposite edges thereof are in adjacent position spaced inwardly of corresponding peripheral edges of said bias-oriented woven interliner ply, and securing means for fixing said aforesaid location of said control ply in relation to said interliner ply, whereby said woven interliner ply yarns immediately adjacent said control ply are adapted to undergo opening movement against the resistance of said non-stretch control ply during the application of said top stitching and subsequent corresponding closing movement in response to said resistance to thereby minimize tension in said top stitching.

10. An improved garment placket as claimed in claim 9 wherein said control ply is a substrate having a plastic content, and said means of securing said control and interliner plies together is by heat fusion causing a bonding attachment of said plastic content of said control ply to said interliner ply.

11. An improved garment placket as claimed in claim 9 wherein said control ply is adhesively secured to said interliner.

12. An improved garment placket as claimed in claim 9 wherein said peripheral edges of said interliner ply are folded in frictionally gripping engagement about the opposite edges of said control ply to thereby achieve said securing together of said interliner and control plies.

* * * * *